United States Patent [19]

Drobish et al.

[11] Patent Number: 4,593,408

[45] Date of Patent: Jun. 3, 1986

[54] EASY OPEN/RECLOSE DEVICE FOR FLEXIBLE PACKAGES

[75] Inventors: James L. Drobish, Wyoming; Gary E. McKibben, Cincinnati, both of Ohio

[73] Assignee: The Procter & Gamble Company, Cincinnati, Ohio

[21] Appl. No.: 664,918

[22] Filed: Oct. 26, 1984

[51] Int. Cl.[4] ..... B65D 33/30

[52] U.S. Cl. ..... 383/43; 383/89; 150/900

[58] Field of Search ..... 383/43, 89; 150/120, 150/900

[56] References Cited

U.S. PATENT DOCUMENTS

| | | | |
|---|---|---|---|
| 1,338,375 | 4/1920 | Kleidman . | |
| 1,798,945 | 3/1931 | Lamarthe . | |
| 1,973,956 | 9/1934 | Hickman | 229/62 |
| 2,080,402 | 5/1937 | Herman | 206/41 |
| 2,093,976 | 9/1937 | Farmer | 229/62 |
| 2,093,978 | 9/1937 | Farmer | 229/62 |
| 2,150,627 | 3/1939 | Lieber | 150/10 |
| 2,158,955 | 5/1939 | Blacher | 383/43 |
| 2,227,390 | 12/1940 | Green | 383/43 |
| 2,232,888 | 2/1941 | Schimelmitz | 150/10 |
| 2,792,168 | 5/1957 | Garcon | 229/65 |
| 2,873,905 | 2/1959 | Denton | 229/55 |
| 3,272,248 | 9/1966 | O'Farrell | 150/10 |
| 3,310,224 | 3/1967 | Laguerre | 229/54 |
| 3,346,883 | 10/1967 | Ersek | 4/1 |
| 3,463,381 | 8/1969 | Wainberg | 229/54 |
| 3,635,376 | 1/1972 | Hellstrom | 222/107 |
| 3,734,154 | 5/1973 | Polk | 383/43 |
| 3,782,601 | 1/1974 | Krawagna | 222/107 |
| 4,317,478 | 3/1982 | Babbidge | 150/10 |
| 4,471,875 | 9/1984 | Hain et al. | 206/632 |
| 4,486,923 | 12/1984 | Briggs | 24/30.5 R |

FOREIGN PATENT DOCUMENTS

| | | | |
|---|---|---|---|
| 1155180 | 4/1958 | France | 383/43 |

*Primary Examiner*—Stephen P. Garbe

*Attorney, Agent, or Firm*—Ronald J. Snyder; John V. Gorman; Richard C. Witte

[57] ABSTRACT

A closure device for a flexible package having an opening is described as including a substantially concavo-convex closure strip mounted at the opening of the package with its convex face oriented toward the interior thereof. The closure strip is resiliently flexible between a stable undeflected position wherein it maintains the opening of the package in closed condition, and a stable deflected position wherein it maintains the opening in a substantially opened condition. The closure strip includes two non-parallel intersecting surfaces which are joined longitudinally along their intersection by a curved fillet-like section having a predetermined radius r. The intersecting surfaces each have a width greater than or equal to a minimum width w; and such surfaces are disposed relative to one another at a predetermined angle $\alpha$ as measured between the adjacent faces of such intersecting surfaces, wherrein angle $\alpha$ is greater than 0° and less than 180° and the value of $r/w^2$ is greater than or equal to 0 $mm^{-1}$ and less than or equal to approximately 0.04 $mm^{-1}$ when the values r and w are measured in millimeter units. The closure device is adapted to adequately serve as a closure for the package while providing convenient and substantial access to the product within when deformed to its stable opened position.

18 Claims, 8 Drawing Figures

Fig. 2
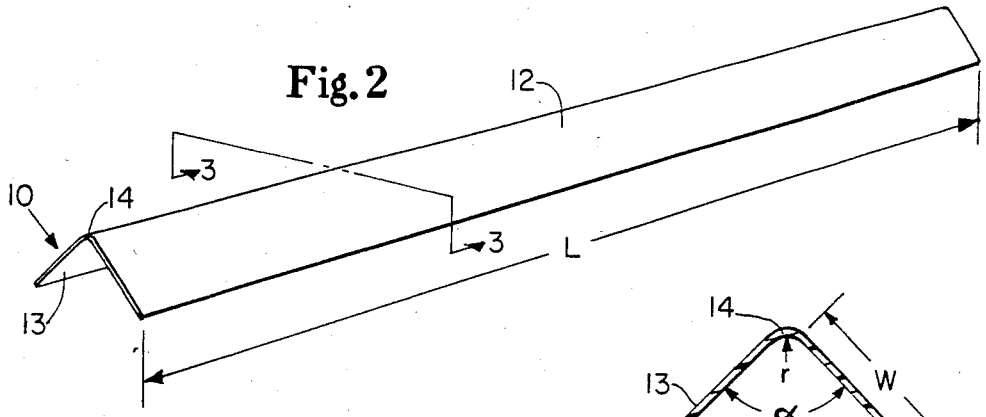
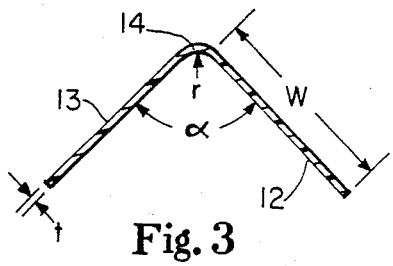
Fig. 3
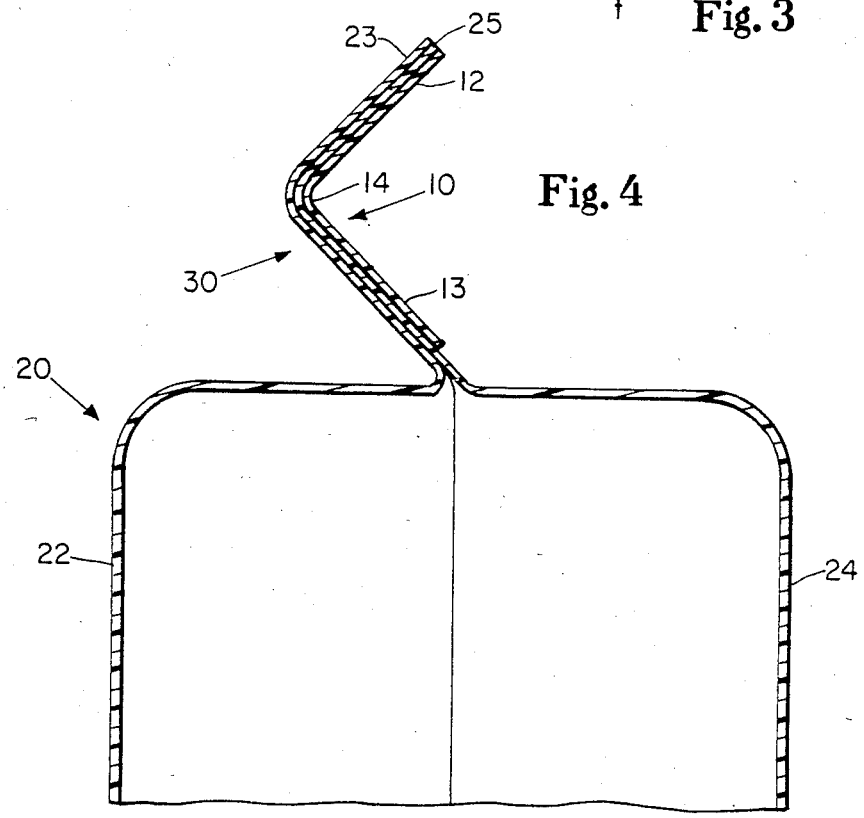
Fig. 4

EASY OPEN/RECLOSE DEVICE FOR FLEXIBLE PACKAGES

TECHNICAL FIELD

This invention concerns easy open/reclose devices for flexible packages, and, more particularly, such closure devices which exhibit stability in both open and closed positions.

BACKGROUND ART

Through the years flexible bags have been used as containers for various products, and in this regard, a variety of structures has been employed to serve as closures for such containers. U.S. Pat. No. 1,798,945, which issued to Alfred Lamarthe on Mar. 31, 1931, for example, discloses a self-closing device for flexible openings in articles such as bags, purses, or tobacco pouches. The Lamarthe patent contemplates a pouch having an open upper portion, with such open portion being provided with a pair of cooperating steel springs for closure thereof. The springs are to be formed of steel bands having a convex side and a concave side, and are arranged on opposite sides of the open upper portion of the pouch such that their concave portions face one another and the interior of the pouch. The pouch is opened by exerting pressure sufficient to move the springs apart from one another in their middle portion, and the springs automatically snap the pouch closed upon release of such pressure.

Another closure for flexible receptacles is described in U.S. Pat. No. 3,272,248, which issued to F. J. O'Farrell on Sept. 13, 1966. The O'Farrell patent shows flexible bags formed from two sheets of superimposed flexible material attached along three of their adjoining edges. A pair of resilient stays are attached or embedded in the opposed sheets of flexible material along their unattached edge such that the stays hold the two sides of the bag closely together in a substantially flat, closed condition. The stays may be fabricated to flex more readily in one direction by scoring or slightly deforming one surface of the individual stays. The O'Farrell patent discloses that stays which have been conditioned for preferred flexing in one direction tend to bend in the direction of the surface having the interruptions or score lines therein. O'Farrell teaches that the surfaces of the stays having the interruptions should be placed in face to face relationship so that such tendency to bend will tightly maintain the bag normally closed. The closure may be opened by squeezing opposite sides or edges of the container together, whereupon release of such squeezing force allows the container to automatically close.

A closure that is allegedly stable both in its closed and open conditions is described in U.S. Pat. No. 3,782,601, which issued to A. Krawagna on Jan. 1, 1974. The Krawagna snap-closure is to be mounted on an open corner of a flexible bag and comprises a relatively ridged curved collar portion, a similarly curved but more resilient plate portion, and a flexible web joining the plate and collar portions. Krawagna states that pressure applied to the plate portion deforms such plate portion from a first position through an intermediate dead-center position to a second inverted position. The plate portion is constructed of a thinner and more resilient material vis-a-vis the more rigid collar portion whose stiff trapezoidal cross-section tends to seek its original curvature and thereby hold the thinner plate portion in one of its two positions. In its closed condition, the snap closure tightly pulls the opposite walls of the flexible bag against the curved plate portion thereby sealing the bag. In its open position, the plate portion no longer seals the walls of the flexible bag and the contents of the flexible container can be dispensed through the resulting opening. Another flexible package which allegedly exhibits both a stable closed position and a stable open position is described in U.S. Pat. No. 3,635,376, which issued to H. Hellstrom on Jan. 18, 1972. The Hellstrom package includes a pair of flexible sheet members, specifically an upper membrane sealed to a lower layer, thereby enclosing a containment space therebetween, and forming a dispensing channel along one edge thereof. A ribbed structure is to be formed within the lower layer and acts to block the dispensing channel when the package is in a closed condition. In such closed condition, the upper membrane is stretched over the rib to form a seal across the dispensing channel. To open the package, bending forces are exerted on the rib causing buckling in one or more places along its length. When such buckling occurs along the rib, the upper membrane is no longer tightly stretched thereover and the dispensing channel is no longer sealed. The Hellstrom patent states that the material of the ribbed structure can be selected so that the buckling becomes more or less permanent, or so that the package will spring back into its original closed position upon release of the bending forces in order to reseal the package.

Despite all of the prior work done in this area, there remain problems in effectively providing an easy open/-reclose structure for flexible bags which can provide a stable and effective seal for the bag and which can be easily opened to form a stable open condition in such bag. These problems are especially emphasized when larger container openings are desired. With prior art closure devices, stable large openings in flexible containers could not easily be obtained economically. Closure devices which provided good sealing qualities did not offer sufficient access to the interior of the container, while devices which provided substantial access were inconvenient and/or did not offer good sealing characteristics.

DISCLOSURE OF THE INVENTION

It is an object of the present invention to obviate the above problems.

It is another object of this invention to provide a closure for flexible containers which will be convenient to open, will remain open to provide easy access to the interior of the container, and will provide convenient reseal characteristics to contain and protect the contents of the container.

It is a further object of the present invention to provide an easy open/reclose device for flexible containers which is simple, convenient and economical.

It is yet another object of the present invention to provide an economical closure device for flexible containers which can be manufactured and incorporated into such flexible containers on high speed equipment.

In accordance with one aspect of the present invention, there is provided a closure device for a flexible package having an opening, with such closure device including a substantially concavo-convex closure strip mounted at the opening of the package with its convex face oriented toward the interior thereof. The closure strip is resiliently flexible between a stable undeflected position wherein it maintains the opening of the package in closed condition, and a stable deflected position wherein it maintains the opening in a substantially opened condition. The closure strip includes two non-parallel intersecting surfaces which are joined longitudinally along their intersection by a curved fillet-like section having a predetermined radius r. Each of the intersecting surfaces has a width greater than or equal to a minimum width w. The intersecting surfaces are disposed relative to one another at a predetermined angle $\alpha$ as measured between the adjacent faces of such intersecting surfaces, wherein angle $\alpha$ is greater than 0° and less than 180° and the value of $r/w^2$ is greater than or equal to 0 $mm^{-1}$ and less than or equal to approximately 0.04 $mm^{-1}$ when the values r and w are measured in millimeter units.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 2 is a perspective view of of the closure strip of the easy open/reclose closure device of FIG. 1;

FIG. 3 is a vertical cross-sectional view of the closure strip of FIG. 2, taken along line 3—3 of FIG. 2;

FIG. 4 is a vertical cross-sectional view of the easy open/reclose closure device and flexible container of FIG. 1, taken along line 4—4 of FIG. 1;

DETAILED DESCRIPTION OF THE INVENTION

Figure 1:
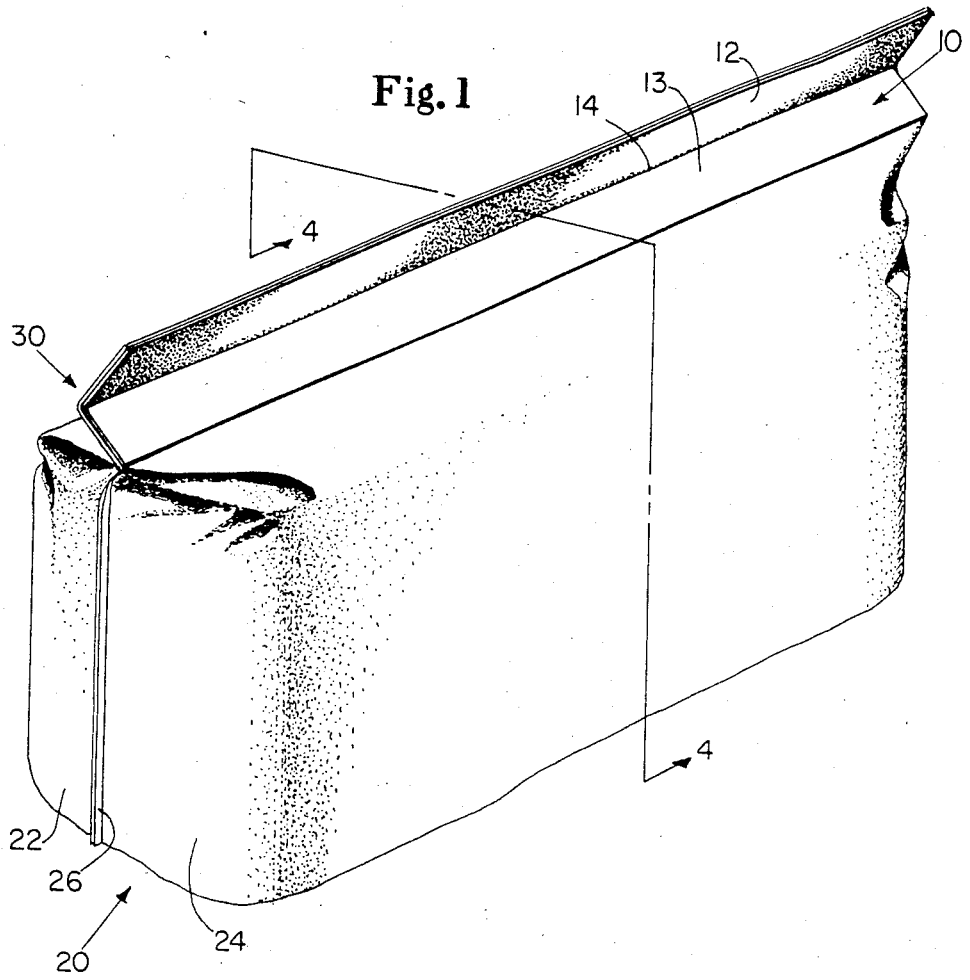
FIG. 1 is a perspective view of the upper portion of a flexible package having an easy open/reclose closure device of the subject invention mounted at the opening of such package and illustrating the closure device in its undeflected closed position.
Figure 5:
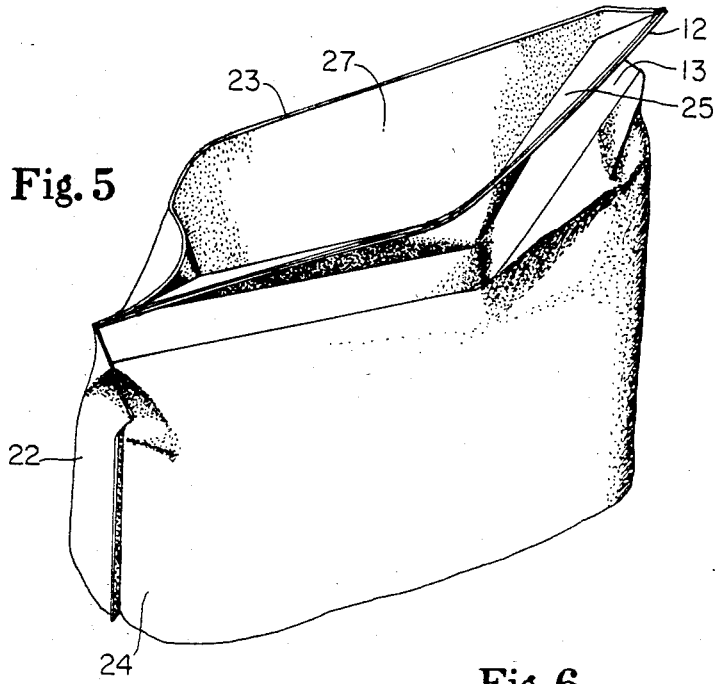
FIG. 5 is a perspective view of the easy open/reclose closure device and flexible container of FIG. 1 after the device has been deflected to its stable open position.

Referring now to the drawings in detail, wherein like numerals indicate the same elements throughout the views, a closure device 30 of the present invention is shown in FIGS. 1, 4 and 5 as mounted at the opening of a flexible package 20. More particularly, closure device 30 comprises a closure strip 10, as shown in detail in FIGS. 2 and 3. Closure strip 10 includes two non-parallel intersecting surfaces 12 and 13, respectively, which are joined longitudinally along their intersection by a curved fillet-like section 14 having a predetermined radius r. Intersecting surfaces 12 and 13 are shown and described as substantially planar, but it is not critical that such surfaces be planar in conformation. Intersecting surfaces 12 and 13 are pictured in the figures as more or less completely planar because the resulting closure strip 10 preferably features a relatively straight and uniform overall conformation which can be more easily manufactured and handled on high speed manufacturing equipment (such characteristics being described more fully below). As used herein the term "surface" shall connote a developable surface, or, more particularly, a surface that can be imagined flattened out on a plane without stretching or shrinking any element of the surface. Therefore, although it is contemplated that any of such developable surfaces could equally be utilized as intersecting surfaces 12 and 13 in accordance with the present invention, substantially planar surfaces are preferred for the above-mentioned reasons.

As seen more particularly in FIG. 3, closure strip 10 is preferably formed of a single piece of material having a thickness t. Surface 12 is shown as having a width w, which is measured from the point of tangency of fillet-like section 14 with surface 12 to the distal edge of surface 12. While it is preferred that the widths of the respective surfaces 12 and 13 be substantially uniform over the length L of closure strip 10 for efficient use of material and to facilitate handling procedures on manufacturing equipment, such widths may vary over length L, with width w simply being the minimum of such varying dimensions. Length L must be at least equal to the width of the opening of a particular package and, for example, can range anywhere from several inches (about 5 cm) to several feet (about 60 cm) or more. The width of planar surface 13 is not specified, however, it is to be a measurement of at least w. Width w may also be varied for particular applications in accordance with relative package size and requirements. For example, for a closure strip 10 having a length L of approximately 220 mm (8.75 inches), width w might be approximately 16 mm (0.625 inches). While width w may vary, it is preferred that w not be excessively large in order to minimize the amount of material needed to construct closure strip 10, thereby minimizing costs thereof. Larger lengths L, however, may have correspondingly larger preferred widths w.

The value of radius r can be chosen to correspond in a practical sense with a chosen width w in light of the desired overall size of a particular closure strip. For example, for a closure strip 10 having a width w of approximately B 16 mm (0.625 inches), a radius r of approximately 1.7 mm (0.066 inches) might be utilized. Alternatively, for a closure strip 10 having a width w of approximately 25.4 mm (1.0 inches), a radius of approximately 5.1 mm (0.2 inches) could be used. It is also contemplated that radius r may be equal to zero, wherein surfaces 12 and 13 would simply be attached along their intersection with no radius therebetween. As will be discussed in more detail below, the ratio of radius r divided by the square of width w (i.e. $r/w^2$) has been found to be critical to the bi-stable characteristics of closure device 30.

As seen best in FIG. 3, surfaces 12 and 13 are disposed relative to one another at a predetermined angle $\alpha$ as measured between the adjacent faces of surfaces 12 and 13, respectively. Angle $\alpha$ is to be greater than 0° and less than 180°; however, it is preferred that angle $\alpha$ be in a range of from about 30° to about 150° for closure device 30 to display optimum functional characteristics, these characteristics being described in greater detail below. Angles $\alpha$ outside of this preferred range may exhibit undesirable characteristics. For example, closure devices having closure strips with angles $\alpha$ outside of the preferred range may require extremely high or extremely low forces for buckling thereof, making such closures inconvenient and/or less effective in use.

Package 20 includes flexible sidewalls 22 and 24 which are connected about their bottom (not shown) and side edges by known methods such as heat sealing, adhesives, etc. Portions of such side edge seals 26 are illustrated in FIG. 1. It should be noted that only the upper portions of flexible package 20 is included in FIGS. 1, 4 and 5. The upper ends 23 and 25 of the flexible sidewalls 22 and 24, respectively, remain unattached to one another to provide an opening 27.

As shown in FIG. 3, closure strip 10 is mounted at the opening of flexible package 20 with its convex face oriented toward the interior thereof. As mentioned, in order to adequately serve as a closure for opening 27, closure strip 10 must have a length L at least as large as the width of opening 27. FIG. 1 illustrates closure strip 10 having a length L equal to the width of opening 27 (i.e. the width of upper ends 23 and 25). Closure strip 10 may be mounted on the exterior surface of either of the upper ends 23 or 25. It is also contemplated that closure strip 10 could alternatively be mounted on the interior surface of either of the flexible sidewalls 23 or 25 with its convex face oriented toward the interior of the package. It is preferred to mount closure strip 10 on the exterior surface, however, in applications where flexible package 20 has been formed prior to mounting of the closure strip thereon. If closure strip 10 were to be mounted prior to or simultaneously with the package formation, interior mounting may be preferred. Closure strip 10 is to be attached to a portion of opening 27 of flexible package 20 such that the portion of opening 27 not attached to closure strip 10 (e.g. upper end 23 of flexible package 20 as shown in the drawings) is longitudinally held taut against the convex face thereof when closure strip 10 is in an undeflected position, thereby maintaining opening 27 in a substantially closed condition (as shown in FIGS. 1 and 4). Closure strip 10 is attached along its length L to the open end of flexible package 20 by any known method such as heat sealing, radio frequency sealing, spot welding, adhesives, etc.

In use, closure strip 10 normally maintains flexible package 20 in closed condition when in its stable undeflected position, as shown in FIGS. 1 and 4. When access is desired to the interior of the flexible package, relatively low bending force exerted against the convex face of closure strip 10 will deform closure strip 10 from its stable undeflected position and will buckle closure strip 10 at a point intermediate its end points. For example, if closure strip 10 has a length L of approximately 152.4 mm (or approximately 6 inches) and is supported at its end points, a force of between about 0.45 kg and about 1.36 kg (between about 1 lb. and about 3 lbs.) exerted against the convex face of closure strip 10 is preferably sufficient to cause buckling. The buckled closure strip 10 will assume a stable deflected position as illustrated in FIG. 5, thereby maintaining opening 27 of flexible package 20 in substantially opened condition until closure strip is returned to its initial undeflected condition.

It has been found that in order to exhibit such bi-stable characteristics, the structure of closure strip 10 must satisfy several critical requirements. The material from which closure strip 10 is formed must demonstrate relatively good fatigue strength and sufficiently high yield strength to allow it to be repeatedly deflected between stable deflected and non-deflected positions without structural failure. While many materials may be found to meet these criteria, thermoplastic materials having a relatively high modulus (e.g. preferably between about 100,000 and about 500,000 psi, or between about 7000 and about 35,000 kg/cm$^2$), and having a yield strength of about 700 kg/cm$^2$ (10,000 psi) or more are preferred. These materials are preferred because closure strip 10 should not buckle too easily or inadvertently, and for economy it is logically best to use a piece of material as thin as practically possible (e.g. a thickness t of between about 0.254 mm and about 0.5 mm, or between about 0.01 in. and about 0.02 in. has been found to economically provide sufficient substance to a closure strip).

As described above, for convenience it is preferred that the force necessary to buckle closure strip 10 be in a range of about 0.453 kg to about 1.36 kg force. Because such force required to buckle closure strip 10 can be adjusted by varying the modulus (i.e. by varying the material used) relative to the thickness t of the particular material chosen; one way to minimize thickness t, is to use material with a higher modulus. In this regard, polyvinyl chloride (commonly known as PVC and available from a variety of sources such as Dayton Plastics, Dayton, Ohio), which has a relatively high modulus of about 21,000 kg/cm$^2$ (about 300,000 psi), has been found to be an excellent material from which to form closure strip 10 as it provides all of the required attributes at relatively low cost.

The thermoplastic material used to form closure strip 10 need not be a singular homogeneous material. For example, a laminated thermoplastic might be used wherein one material layer provides strength while another layer provides good bonding of the closure strip to the flexible package. Further, it should be understood that the thickness t of any particular closure strip 10 might also vary among particular points on the surface due to manufacturing and/or forming imperfections, etc. In this regard, thickness t, as used herein, connotes the nominal thickness of the material from which closure strip 10 is formed.

It has also been observed that while thickness t of the material used to fabricate a closure strip must be taken into account along with modulus of the material in determining the buckling force which will be required to deform closure strip 10 from its stable undeflected position to its stable deflected position, thickness t has no substantial effect on bi-stable characteristics of closure strips made therefrom.

It has also been found that in order for closure strip 10 to demonstrate bi-stable characteristics, the ratio of radius r to the square of width w (i.e. $r/w^2$) for any particular material will be substantially a constant number, and when r and w are measured in millimeter units that constant number will be within the range of between 0 and about 0.04 mm$^{-1}$. If r and w are alternatively measured in inch units, the range of $r/w^2$ is between 0 and about 1.0 inches$^{-1}$. For example, in order to be bi-stable, in a closure strip 10 formed of PVC having a modulus of about 21,000 kg/cm$^2$ (about 300,000 psi), the ratio of $r/w^2$ (r and w measured in millimeter units) must be less than or equal to 0.04 mm$^{-1}$ and greater than or equal to 0 mm$^{-1}$ for any particular angle $\alpha$. Similarly, a closure strip 10 made of polypropylene (available from a variety of sources such as Dayton Plastics) having a modulus of about 13,000 kg/cm$^2$ (about 185,000 psi), must also exhibit a ratio of $r/w^2$ within that same range. Likewise, closure strips made of polyethylene material (available from a variety of sources such as Dayton Plastics) having a modulus of between about 560 and 1700 kg/cm$^2$ (between about 8,000 and 25,000 psi) must have an $r/w^2$ ratio in that same approximate range to exhibit bi-stable characteristics. Therefore, while the moduli of different materials will vary, it has been established that in order to exhibit bi-stable characteristics a closure strip 10 must have a ratio of $r/w^2$ in a range of from about 0 to about 0.04 $mm^{-1}$ when the values of r and w are measured in millimeter units. While the $r/w^2$ ratio of a particular closure strip may vary slightly along its length L, at least the portion of closure strip 10 which is to be bi-stable must have an $r/w^2$ ratio within the approximate range described above. Further, to insure optimum bi-stable functional characteristics, values of $r/w^2$ near the upper or lower limits of this range should preferably be avoided.

The process of forming closure strip 10 is not critical and can be achieved by a variety of known processes such as thermoforming, injection molding, hot rolling, cold or hot forging, or the like. Further, it is conceivable that closure strip 10 could be formed as the combination of several pieces attached together. As mentioned earlier, it is preferred that surfaces 12 and 13 be substantially planar to facilitate manufacturing operations. Such substantially planar surfaces insure a substantially straight (i.e. having all points along its length substantially parallel to a single transverse axis) closure strip 10 which can be more easily formed and handled on high speed manufacturing lines. As mentioned, deviations from flat or planar surfaces can equally be utilized and might be preferred in applications where a closure device with a curvilinear conformation is desired. Large deviations from substantially planar surfaces might interfere with high speed manufacturing of such closures, and might necessitate equipment modification or appropriate manufacturing procedure modifications; however, it is believed that such structures would function in substantial accord with the principles described herein.

Figure 6:
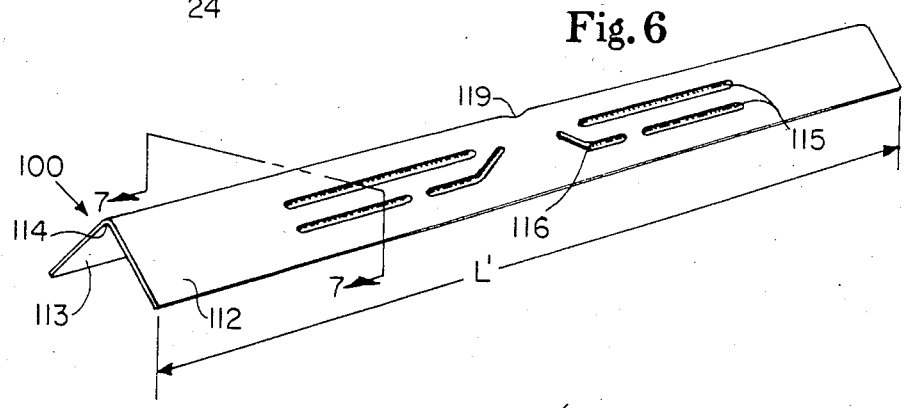
FIG. 6 is a perspective view of an alternate embodiment of the closure strip of an easy open/reclose closure device of the subject invention.
Figure 7:
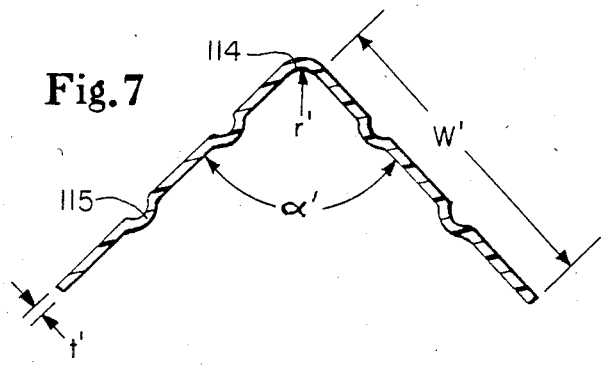
FIG. 7 is a vertical cross-sectional view of the closure strip of FIG. 5, taken along line 7—7 of FIG. 6.

FIGS. 6 and 7, illustrate an equally preferred closure strip made in accordance with the subject invention. Closure strip 100 includes means designed to help confine the buckling action of the closure strip to a predetermined area intermediate its end points. In particular, horizontal reinforcing ribs 115 and angled reinforcing ribs 116 serve to strengthen closure strip 100 generally along its length L' except at its centermost area. Additionally, a weakening depression 119 has been formed along the intersection 114 of closure strip 100 to further predispose closure strip 100 to buckle at that point. As shown in FIG. 7, such reinforcing and/or weakening structures can be integrally formed as part of closure strip 100. Proper location of such structures will insure that closure strip 100 will tend to buckle at a predetermined point, such as at its center, to provide relatively uniform and predictable access to the interior of a flexible package. The precise means by which such buckling is to be confined to particular areas along length L' of closure strip 100 is not critical and can be accomplished by various reinforcing and/or weakening means known or conceivable to one skilled in the art.

In addition to predetermining the area or areas in which it is desired that closure strip 100 will buckle when deformed from its undeflected position to is deflected position, reinforcing and/or weakening means might also be used to adjust the bending force needed to buckle the structure in order to adapt a particular closure strip to a particular application. For example, if higher buckling force were desired in order to provide a more firm closure seal or to prevent small children from opening the package, reinforcement could be provided to increase the required force without necessitating a material selection change (i.e. higher material modulus) or an increase in the material thickness of the closure strip. Such reinforcement might also be useful in reducing the required thickness t for a given material modulus, thereby minimizing material cost of a closure device.

Figure 8:
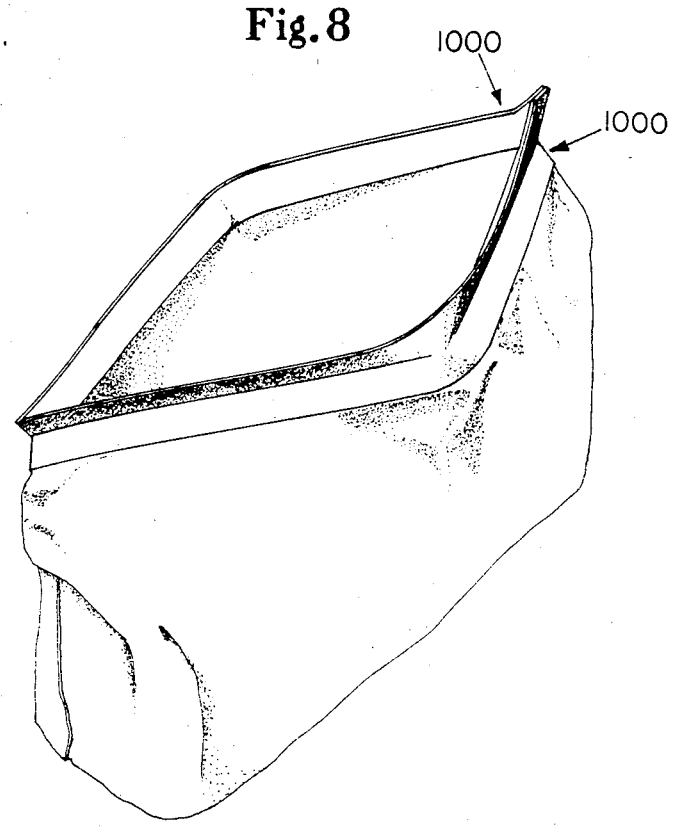
FIG.8 is a perspective view of a third embodiment of the easy open/reclose closure device of the subject invention including two oppositely disposed closure strips mounted at the opening of a flexible package, shown after the device has been deflected to its stable open position.

In other applications, it might be desirable to provide a package opening which can be maintained in the opened condition about its entire periphery to allow even greater access to the contents therein. Such a closure device could be achieved by mounting a pair of closure strips as described herein on opposite sides of the opening of a flexible package. In such a closure device (as shown in FIG. 8), a pair of substantially concavo-convex closure strips 1000 or closure strips 10 or 100, as described above) could be mounted on opposite sides of the opening of a flexible package with their convex faces oriented toward one another and toward the interior of the package. The closure strips in such an arrangement could be connected to one another at their end points, but such integral attachment is not necessary. Such closure strips might also include means to facilitate imposition of bending forces thereon, such as pull tabs or handles. In use, a consumer would simply apply bending force to each of the closure strips in the direction of their concave faces, thereby buckling the closure strips intermediate their end points, whereby the closure strips would assume their stable deflected position and maintain substantially the entire opening of the container in a substantially opened condition (as illustrated in FIG. 8) until the closure strips are returned to their stable initial undeflected positions. The individual closure strips in such an arrangement could be provided with reinforcing and/or weakening means, as described above, to confine buckling to a desired point (or points) intermediate the end points of a particular closure strip. By predetermining such buckling points, the overall shape of the stable open closure device could be predetermined. For example, if both closure strips were designed to buckle at their center points, the resulting opening would be substantially square in conformation.

Having shown and described the preferred embodiments of the present invention, further adaptions of the closure device can be accomplished by appropriate modifications by one of ordinary skill in the art without departing from the scope of the present invention. For example, any of the closure strips described herein could be adapted to serve in the additional capacity as a convenient carrying structure (e.g. by including handles) for the flexible package. Another modification might include integrally forming the closure strip of the closure device with at least one of the flexible sidewalls of the package. Such integral formation might be accomplished by simply increasing the thickness of the sidewall in the upper portions where the closure strip is formed. This may necessitate having a slightly more rigid sidewall in order to provide the functional characteristics required in the closure strip.

Accordingly, the scope of the present invention should be considered in terms of the following claims and is understood not to be limited to the details of structure and operation shown and described in the specification and drawings.

We claim:

1. A closure device for a flexible package having an opening, said closure device comprising a substantially concavo-convex closure strip mounted at said opening with its convex face oriented toward the interior of said package and being resiliently flexible between a stable undeflected position, wherein said opening is maintained in a closed condition, and a stable deflected position, wherein said opening is maintained in a substantially opened condition, said closure strip comprising two non-parallel intersecting surfaces which are joined longitudinally along their intersection by a curved fillet-like section having a predetermined radius r, said intersecting surfaces each having a minimum width greater than or equal to a predetermined width w, and said intersecting surfaces being disposed relative to one another at a predetermined angle $\alpha$ as measured between the adjacent faces of said intersecting surfaces, wherein angle $\alpha$ is greater than 0° and less than 180° and the value of $r/w^2$ is greater than or equal to 0 $mm^{-1}$ and less than or equal to approximately 0.04 $mm^{-1}$ when the values r and w are measured in millimeter units.

2. The closure device of claim 1, wherein said closure strip is resiliently flexible to said stable deflected position when bent in the direction of its concave face thereby buckling said closure strip intermediate its end points, said stable deflected position maintaining substantially the entire opening of said package in substantially opened condition until said closure strip is returned to said stable undeflected position.

3. The closure device of claim 2, wherein said closure strip is formed from a single piece of thermoplastic material.

4. The closure device of claim 3, wherein angle $\alpha$ is approximately 80°, width w is approximately 16 mm (0.625 in.), and radius r is approximately 1.7 mm (0.066 in.).

5. The closure device of claim 4, wherein each of said intersecting surfaces has a substantially planar conformation.

6. A closure device for a flexible package having an opening, said closure device comprising a substantially concavo-convex closure strip mounted at said opening with its convex face oriented toward the interior of said package such that the portion of the opening not attached to said closure strip is longitudinally held taut against said convex face when said closure strip is in undeflected position, said closure strip being resiliently flexible between its stable undeflected position, wherein said opening is maintained in a closed condition, and a stable deflected position, where said opening is maintained in a substantially opened condition, said closure strip comprising two non-parallel intersecting surfaces which are joined longitudinally along their intersection by a curved fillet-like section having a predetermined radius r, said intersecting surfaces each having a minimum width greater than or equal to a predetermined width w and being disposed relative to one another at a predetermined angle $\alpha$ as measured between the adjacent faces of said intersecting surfaces, wherein angle $\alpha$ is greater than 0° and less than 180° and the value of $r/w^2$ is greater than or equal to 0 $mm^{-1}$ and less than or equal to approximately 0.04 $mm^{-1}$ when the values r and w are measured in millimeter units.

7. The closure device of claim 6, wherein each of said intersecting surfaces has a substantially planar conformation.

8. The closure device of claim 7, wherein said closure strip is resiliently flexible to said stable deflected position when bent in the direction of its concave face thereby buckling said closure strip intermediate its end points, said closure strip being stable in said deflected position thereby maintaining substantially the entire opening of said in substantially opened condition until said closure strip is returned to said stable undeflected position.

9. The closure device of claim 8, wherein said closure device is formed from a single piece of thermoplastic material.

10. The closure device of claim 9, wherein angle $\alpha$ is approximately 80°, width w is approximately 16 mm (0.625 in.), and radius r is approximately 1.7 mm (0.066 in.).

11. A closure device for a flexible package having an opening, said closure device comprising a pair of substantially concavo-convex closure strips mounted on opposite sides of said opening with their convex faces oriented toward one another and toward the interior of said package, said closure strips being resiliently flexible between a stable undeflected position, wherein said opening is maintained in a closed condition, and a stable deflected position, wherein said opening is maintained in a substantially opened condition, each concavo-convex closure strip comprising two non-parallel intersecting surfaces which are joined longitudinally along their intersection by a curved fillet-like section having a predetermined radius r, said intersecting surfaces each having a minimum width greater than or equal to a predetermined width w and being disposed relative to one another at a predetermined angle $\alpha$ as measured between the adjacent faces of said intersecting surfaces, wherein angle $\alpha$ is greater than 0° and less than 180° and the value of $r/w^2$ is greater than or equal to 0 $mm^{-1}$ and less than or equal to approximately 0.04 $mm^{-1}$ when the values r and w are measured in millimeter units.

12. The closure device of claim 11, wherein each of said intersecting surfaces of said concavo-convex closure strips has a substantially planar conformation.

13. The closure device of claim 12, wherein said concavo-convex closure strips are resiliently flexible to said stable deflected positions when bent in the direction of their concave faces and buckled intermediate their end points, said stable deflected positions maintaining substantially the entire opening of said package in substantially opened condition until said closure strips are returned to their stable undeflected position.

14. The closure device of claim 13, wherein each of said concavo-convex closure strips is formed from a single piece of thermoplastic material.

15. The closure device of claim 14, wherein each of said substantially concavo-convex closure strips has a width w of approximately 16 mm (0.625 in.), a radius r of approximately 1.7 mm (0.066 in.), and an angle $\alpha$ of approximately 80°.

16. The closure device of claims 1, 6 or 11, wherein each closure strip includes means to help direct said buckling to a predetermined area intermediate the end points of said closure strip.

17. The closure device of claim 16, wherein said means to help direct said buckling comprises strengthening ribs on said intersecting surfaces, said strengthening ribs designed to strengthen said closure strip in areas where buckling is not desired.

18. The closure device of claim 16, wherein said means to help direct said buckling further comprises weakened areas on each closure strip.

* * * * *